US005499085A

United States Patent [19]

Christy et al.

[11] Patent Number: 5,499,085

[45] Date of Patent: Mar. 12, 1996

[54] TRAILING EDGE DUST CONTROL

[75] Inventors: Orrin D. Christy, North Tonawanda; Kevin J. Hook, Grand Island; David Hargreaves, North Tonawanda; Mark E. Ruchalski, West Seneca; Michael D. Akins, North Tonawanda, all of N.Y.

[73] Assignee: Moore Business Forms, Inc., Grand Island, N.Y.

[21] Appl. No.: 470,707

[22] Filed: Jun. 6, 1995

[51] Int. Cl.[6] ..... G03G 15/09

[52] U.S. Cl. ..... 355/273; 347/112; 347/155; 430/126

[58] Field of Search ..... 355/273, 277, 355/279; 347/155, 156, 112, 120, 140, 153, 158; 430/126, 98

[56] References Cited

U.S. PATENT DOCUMENTS

| | | | |
|---|---|---|---|
| 4,014,605 | 3/1977 | Fletcher | 355/273 |
| 4,260,235 | 4/1981 | Stack | 355/215 |
| 5,010,370 | 4/1991 | Araya et al. | 355/274 |
| 5,198,864 | 3/1993 | Fletcher | 355/274 |
| 5,253,023 | 10/1993 | Hosaka et al. | 355/279 |
| 5,282,006 | 1/1994 | Fletcher | 355/273 |

*Primary Examiner*—Joan H. Pendegrass
*Assistant Examiner*—Sophia S. Chen
*Attorney, Agent, or Firm*—Nixon & Vanderhye

[57] ABSTRACT

Charged toner is transferred from an image member (such as an image cylinder or belt) to a web of imagable material (typically paper), preferably utilizing a rotating conductive impression cylinder. The toner, having a first polarity, is applied to the image member. The paper web, typically by contact with the impression cylinder, is moved into contact with the image member so that the toner transfers from the image member to the web under pressure. Even despite a high speed of movement of the web (e.g. 200 feet per minute or more), toner back scatter is substantially prevented by applying an electrical bias of the first polarity to the impression cylinder so as to impose an electric force field on the toner particles of sufficient intensity to overcome aerodynamic drag forces which would separate particles from the image areas between the impression cylinder and the image member. While the applied potential is typically between about 100–600 volts, in order to take care of all speeds and all types of toners and all types of printer geometries, a fixed potential of about 750 volts may be utilized. Where the image member is an image cylinder, a nip is provided between the cylinders at which, or immediately adjacent to, toner transfer takes place.

20 Claims, 2 Drawing Sheets

TRAILING EDGE DUST CONTROL

BACKGROUND AND SUMMARY OF THE INVENTION

In the majority of non-impact printing processes, toner transfer to paper substrates is accomplished by electrostatic transfer using an electrically biased roller or a corona source. Most processes operate at low speeds where the dynamic forces at the toner transfer point are such that transfer is accomplished without an appreciable scatter of toner from the image area. Higher speed systems, however, using an electrically biased roller or a pressure roller suffer from a problem with scattering of the toner at the nipping point. Such scatter is often referred to as back scatter, trailing edge dusting, or character puffing. It is caused by the physical blowing of toner from the image area due to the reversal of the trapped entrained air streams which follow the image cylinder and paper into the nipping point. The high velocity air stream going counter to the direction of the toner breaks the electrostatic adhesion force holding the toner to the image member.

The effect of blowing toner typically does not start until a particular linear speed of the paper web exceeds a certain amount. For example, with a Midax 300 electrostatic printing system, available from Moore Business Forms, Lake Forest, Illinois, serious back scatter does not take place until the speeds are greater than about 200 fpm; for a Nipson-Bull Varypress (which may include a vacuum knife preceding the nip point to lower the atmospheric pressure in the area to reduce back scatter), back scatter starts to significantly occur when speeds greater than 150 fpm are reached.

According to the present invention, a simple method and apparatus are provided which substantially eliminate the problem of back scatter even at speeds significantly in excess of 200 fpm. The desirable results according to the invention are essentially accomplished by applying an electrical potential in the vicinity of the transfer from the image member to the web of paper that has the same polarity as the toner particles on the image member, so that the combination of the adhesion force and the field force applied according to the invention overcome the aerodynamic forces, and trailing edge dusting is almost completely eliminated.

According to one aspect of the present invention a method of transferring charged toner from an image member to a web of imagable material (typically paper) is provided using an impression cylinder with a nip between the image member and impression cylinder comprising the steps of: (a) Applying toner having a first polarity to the image member. (b) Moving the web of imagable material at a linear speed in excess of about 150 fpm into contact with the image member to effect toner transfer. (c) Effecting pressure transfer of the toned image from the image member to the paper using the nip between the image member and impression cylinder. And (d) substantially preventing toner back scatter by applying an electrical bias of the first polarity in the vicinity of the area of contact between the image member and the web so as to impose an electric force field on the toner particles of sufficient intensity to overcome aerodynamic drag forces which would separate the particles from the image member before application to the web.

Step (b) is typically practiced in excess of 200 feet per minute, and step (c) is practiced by applying a fixed or varying potential of about 100–600 volts in the vicinity of the area of contact between the image member and the web, or by applying a fixed potential of about 750 volts in order to accommodate all types of toners, possible web speeds, and geometries. Steps (a) and (d) are both typically practiced to apply a positive charge, although a negative charge may also be applied in both situations.

According to another aspect of the present invention a non impact, electrostatic printing device is provided. The device comprises the following components: An image member to which toner having a first polarity is applied. A conductive impression cylinder having an outer periphery. Means for rotating the impression cylinder about an axis. The image member and impression cylinder being positioned with respect to each other to provide a nip, and so that a web of imagable material passes between the image member and the outer periphery of the impression cylinder so that toner from the image member is transferred to the web of material by pressure fixing the toner at the nip. And means for applying an electrical potential of the first polarity to the impression cylinder of sufficient intensity so as to substantially prevent back scatter of toner as a result of aerodynamic forces acting between the image member and impression cylinder.

The image member may comprise an image belt, an image cylinder, or a wide variety of other structures which are used to transfer toner to a web. Where an image cylinder is utilized, means are provided for rotating an image cylinder about an axis slightly skewed with respect to the axis of the impression cylinder, the cylinders being rotated in different directions and having the nip therebetween. The image and impression cylinders are typically rotated at such a speed that the tangential speeds thereof (and thus the speed of the web) are greater than about 200 fpm. The means for applying an electrical potential comprises any conventional power supply, and a universal potential of about 750 volts will take into account all different types of toners and speeds.

According to another aspect of the present invention, a method of transferring charged toner from an image member to a web of imagable material using an impression cylinder is provided. The method comprises the following steps: (a) Applying toner having a first polarity to the image member. (b) Moving the web of imagable material by contact with the impression cylinder into contact with the image member so that toner transfers from the image member to the web. And (c) substantially preventing toner back scatter by applying an electrical bias of said first polarity to the impression cylinder so as to impose an electric force field on the toner particles of sufficient intensity to overcome aerodynamic drag forces which would separate the particles from image areas between the impression cylinder and image member.

Typically the image member and the impression cylinder are moved at a tangential or linear speed greater than about 200 fpm, and step (c) is practiced by applying a fixed or varying potential of about 100–600 volts, more preferably a fixed potential of about 300–400 volts, although a potential of about 750 volts takes care of all varieties of toners and speeds. The web of imagable material is typically paper.

It is a primary object of the present invention to hold charged toner in a desired position with respect to an image member until the web to which transfer is to take place is in direct contact with the toner so as to substantially eliminate back scatter. This and other objects of the invention will become clear from an inspection of the detailed description of the invention, and from the appended claims.

DETAILED DESCRIPTION OF THE DRAWINGS

Figure 1:
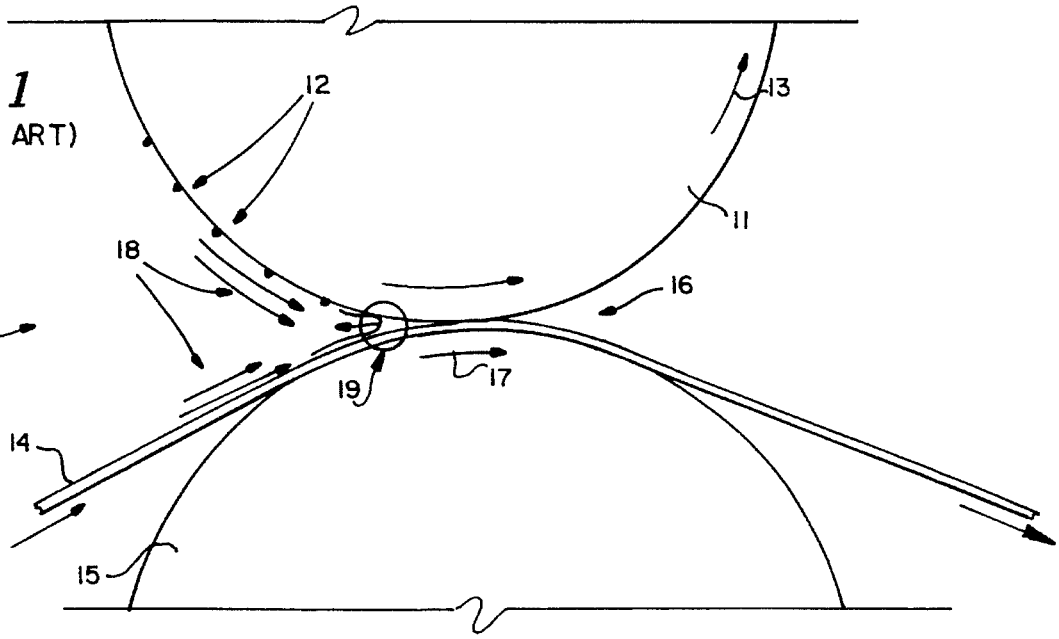
FIG. 1 (PRIOR ART)
FIG. 1 is a side schematic view showing the operative components of an electrostatic non-impact printing device according to the prior art at which back scatter may take place.

FIG. 1 shows a conventional throughput non-impact electrostatic printing system 10 according to the prior art, the components actually illustrated in FIG. 1 simulating a Midax 300 printing system, available from Moore Business Forms of Lake Forest, Illinois. System 10 includes an image cylinder 11 on which developed toner images 12 are provided, the cylinder rotating in a counterclockwise direction as illustrated by arrow 13. A paper web 14 is transported by the impression cylinder 15, and other drive apparatus typically both before and after the impression cylinder 13, into the nip 16 between cylinders 13, 15, cylinder 15 being rotated in the clockwise direction as indicated by arrow 17 in FIG. 1.

Figure 2:
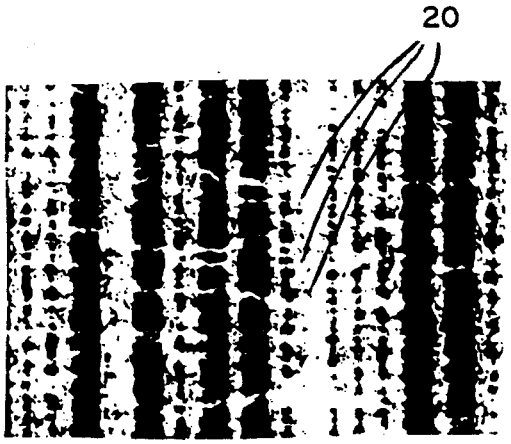
FIG. 2 (PRIOR ART)
FIGS. 2 and 3 are schematic showings of back scatter printing which is undesirably obtained utilizing the apparatus of FIG. 1.
Figure 3:
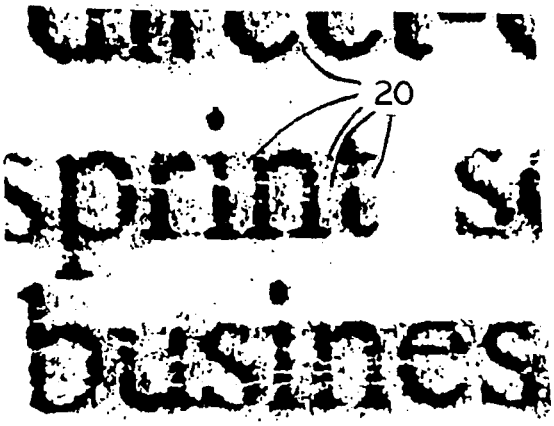
FIG. 3 (PRIOR ART)

FIG. 1 schematically illustrates the phenomena of back scattering which will occur if the linear speed of the paper web 14 is too high, e.g. about 200 fpm or more in the case of a Midax 300 printer. Entrained air streams 18 which follow the cylinders 13, 15 during their rotation become trapped at or adjacent the nip point 16, as indicated by the area 19 of FIG. 1, which is the reversal region where entrained air streams reverse and drag some of the toner 12 backwards, away from the nip 16. That is, the high velocity air stream from the reversal region 19 going counter to the direction of toner 12 movement breaks some of the electrostatic adhesion forces holding the toner 12 to the image cylinder 11, causing back scattering. Back scattering and breaks within the characters are clearly evident in FIG. 2, which shows a bar code, and FIG. 3, which shows printed words. The simulations illustrated in FIGS. 2 and 3 in which numerous areas of back scatter illustrated by reference numerals 20 in FIGS. 2 and 3—are what typically occur operating a Midax 300 system (10) at about 250 fpm.

Figure 4:
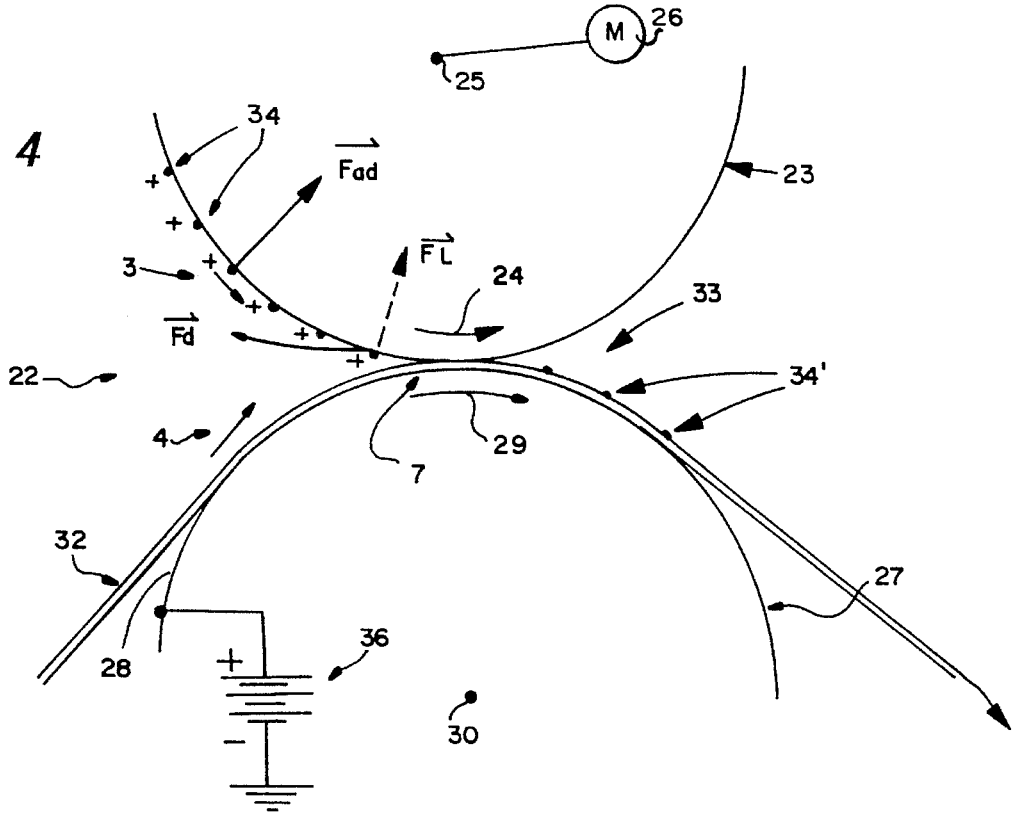
FIG. 4 is a view like that of FIG. 1 only of the apparatus according to the present invention.

FIG. 4 schematically illustrates an electrostatic printing system 22 according to the present invention. The system 22 includes the same basic components as the system 10, including an image cylinder 23 which is driven in the counterclockwise direction indicated by arrow 24 about an axis 25 as by a conventional rotating means, such as electric motor 26, and a conductive impression cylinder 27 having a periphery 28 and which is rotated clockwise in the direction of arrow 29 about the axis 30 by its tight contact to the image cylinder 23. The web 32 of imagable material (typically paper) is moved into the nip 33 between the rollers or cylinders 23, 27 at which point developed toner 34 which is electrostatically adhered to the periphery of the image cylinder 23 is transferred to the web 32 using pressure. The toned image on the paper is subsequently fused permanently to the paper 32 using conventional heat fusion means [not shown].

What is unique according to the invention of FIG. 4 is the application of an electric field force to hold the charged toner particles 34 onto the image cylinder 23 just prior to the nip 33, to substantially eliminate back scatter. The electric field that is applied provides the repulsive force which cooperates with the electrostatic force to hold the charged toner particles 34 on the cylinder 23, but it does not interfere with transfer at the nip 33, the toner particles transferring as the printing 34' on the web 32. Typically the electric field is provided by using a power supply 36 as seen in FIG. 4 which applies an electrical potential using an electrically conductive brush [not shown]to the periphery 28 of the impression cylinder 27. The power supply 36 comprises means for applying an electrical potential of the same polarity as the particles 34 (e.g. positive) of sufficient intensity so as to substantially prevent back scatter of toner as a result of aerodynamic forces acting between the image cylinder 23 and the impression cylinder 27. The power supply 36 may be any conventional source, such as a DC generator, battery, power grid, or any other source. The polarity of the power supply 36 is such that it applies the same polarity to the periphery 28 as the polarity of the toner particles 34 (typically, although not necessarily, a positive polarity). In many situations—such as for the Midax 300—impression cylinder 27 is made from Delrin with about a 20% load of carbon black to harden it. This material is quite conductive, and when biased to a fixed potential of between 100–600 volts by the power supply 36 (e.g. between about 300–400 volts) produces an acceptable electric force.

Figure 5:
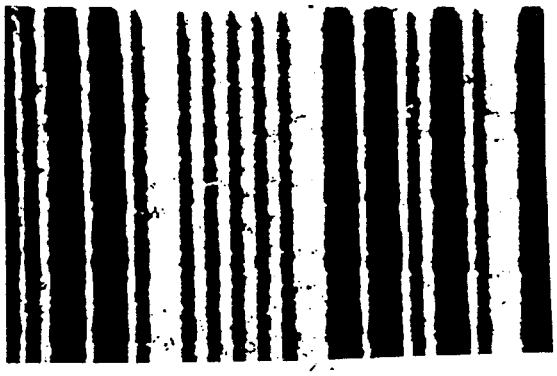
FIGS. 5 and 6 are schematic representations of the improvement in printing achieved according to the invention compared with the prior art of FIGS. 2 and 3.
Figure 6:
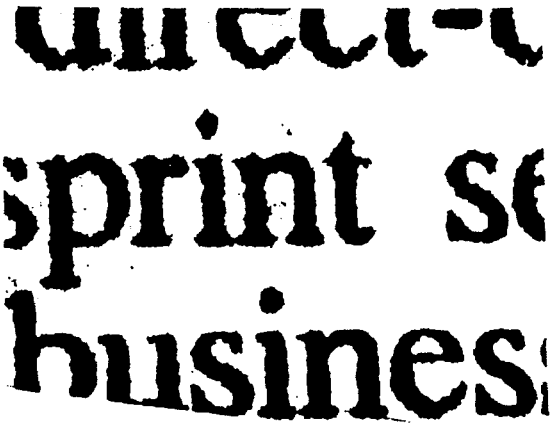

For example, with respect to FIG. 4, the toner 34 is typically held to the image cylinder 23 by an electrostatic adhesion force $F_{ad}$ as seen in FIG. 4. The aerodynamic drag force $F_d$ tends to pull some of the toner particles 34 away from the cylinder 23, the force $F_d$ often being strong enough to overcome the electrostatic adhesion force $F_{ad}$ alone. However, because of the electric field supplied by the power supply 36 a further force $F_1$ is added to the toner particles 34 on the image cylinder 23, the combination of the forces $F_{ad}$ and $F_1$ (the electric field force or the Lorentz force) being large enough to overcome the aerodynamic force $F_d$, so that trailing edge dusting is almost completely eliminated. That this trailing edge dusting or back scatter is almost completely eliminated can be seen from FIGS. 5 and 6. The images in FIGS. 5 and 6 were printed on exactly the same Midax 300 machine as those of FIGS. 2 and 3, at substantially the identical speed of 250 fpm, only when the images of FIGS. 5 and 6 were printed the power supply 36 applied a positive voltage of about 500 volts to the impression cylinder 27 periphery 28.

While the invention has been described with respect to an image cylinder 23, it should be understood that any type of conventional image member may be utilized to which toner particles 34 may adhere, such as an image belt, image web, etc.

It is also to be understood that the exact manner in which the electric field is applied may be varied within the scope of the invention, and depending upon the geometry of the electrostatic printing equipment. While the voltage applied by power supply 36 in the range of 100–600 volts, preferably 300–400 volts is desired, if one wishes to cover all types of toners over all speed ranges the bias applied by power supply 36 may be in the range of a fixed potential of about 750 volts. Varying potentials may also be applied according to the invention depending upon the speed of the web 32, the potential applied being automatically increased as the web speed increases. It is difficult to quantify exactly what the desired charge density should be because it depends a great deal on the particular toner particles and printer geometry. In all instances it is merely necessary—and as can be determined empirically—to apply an electric field force on the toner particles sufficient to overcome the aerodynamic drag forces which would separate them from the image areas and create trailing toner scatter.

It will thus be seen that according to the present invention an advantageous method and apparatus have been provided to substantially eliminate back scatter during high speed electrostatic non-impact printing procedures. While the invention has been herein shown and described in what is presently conceived to be the most practical and preferred embodiment thereof, it will be apparent to those of ordinary skill in the art that many modifications may be made thereof within the scope of the invention (particularly to accommodate different printer geometries and elements), and the claims should be interpreted broadly so as to encompass all equivalent printer systems and methods.

What is claimed is:

1. A method of transferring charged toner from an image member to a web of imagable material using a conductive impression cylinder, comprising the steps of:

(a) applying toner having a first polarity to the image member;

(b) moving the web of imagable material by contact with the conductive impression cylinder into contact with the image member so that toner transfers from the image member to the web; and (c) substantially preventing toner back scatter by applying an electrical bias of said first polarity to the impression cylinder so as to impose an electric force field on the toner particles of sufficient intensity to overcome aerodynamic drag forces which would separate the particles from image areas between the impression cylinder and image member.

2. A method as recited in claim 1 wherein the image member and impression cylinder are moved at a tangential or linear speed of greater than about 200 fpm.

3. A method as recited in claim 2 wherein step (c) is practiced by applying a fixed potential of about 750 volts to the impression cylinder.

4. A method as recited in claim 2 wherein step (c) is practiced by applying a fixed or varying potential of about 100–600 volts.

5. A method as recited in claim 2 wherein step (c) is practiced by applying a fixed potential of about 300–400 volts.

6. A method as recited in claim 3 wherein steps (a) and (c) are both practiced to apply a positive charge.

7. A method as recited in claim 1 wherein steps (a) and (c) are both practiced to apply a positive charge.

8. A method as recited in claim 1 wherein the image member comprises a conductive image cylinder, and comprising the further step of rotating the image cylinder in the opposite direction as the impression cylinder, a nip being formed therebetween, toner transfer to the web taking place by pressure at the nip.

9. A method as recited in claim 8 wherein the web of imagable material is paper.

10. A method as recited in claim 3 wherein the image member comprises a conductive image cylinder, and comprising the further step of rotating the image cylinder in the opposite direction as the impression cylinder, a nip being formed therebetween, toner transfer to the web taking place by pressure at the nip.

11. A method as recited in claim 1 wherein step (c) is practiced by applying a fixed potential of about 750 volts to the impression cylinder.

12. A method as recited in claim 11 wherein the web of imagable material is paper.

13. A non-impact, electrostatic printing system comprising:

an image member to which toner having a first polarity is applied;

a conductive impression cylinder having an outer periphery;

means for rotating said impression cylinder about an axis;

said image member and impression cylinder being positioned with respect to each other to provide a nip, and so that a web of imagable material passes between said image member and said outer periphery of said impression cylinder so that toner from said image member is transferred to the web of material by pressure fixing of the toner at the nip; and means for applying an electrical potential of said first polarity to said impression cylinder of sufficient intensity so as to substantially prevent back scatter of toner as a result of aerodynamic forces acting between said image member and impression cylinder.

14. A printing device as recited in claim 13 wherein said means for applying an electrical potential comprises means for applying a fixed potential of about 750 volts to said impression cylinder.

15. A printing device as recited in claim 13 wherein said image member comprises an image cylinder, said nip formed between said image cylinder and impression cylinder.

16. A printing device as recited in claim 15 further comprising means for rotating said image cylinder about an axis slighty skewed with respect to said axis of said impression cylinder, said rotating means rotating said cylinders about said axes so that the tangential speeds thereof are greater than about 200 fpm.

17. A method of transferring charged toner from an image member to a web of imagable material using an impression cylinder with a nip between the image member and impression cylinder, comprising the steps of:

(a) applying toner having a first polarity to the image member;

(b) moving the web of imagable material at a linear speed in excess of about 150 fpm into contact with the image member to effect toner transfer;

(c) effecting pressure transfer of the toned image from the image member to the paper using the nip between the image member and impression cylinder; and (d) substantially preventing toner back scatter by applying an electrical bias of said first polarity in the vicinity of the area of contact between the image member and the web so as to impose an electric force field on the toner particles of sufficient intensity to overcome aerodynamic drag forces which would separate the particles from the image member before application to the web.

18. A method as recited in claim 17 wherein step (b) is practiced at speeds in excess of 200 fpm, and wherein step (d) is practiced by applying a fixed potential of about 750 volts in the vicinity of the area of contact between the image member and the web.

19. A method as recited in claim 17 wherein step (d) is practiced by applying a fixed or varying potential of about 100–600 volts.

20. A method as recited in claim 17 wherein steps (a) and (d) are both practiced to apply a positive charge.

* * * * *